US009157713B1

(12) United States Patent
Peterson et al.

(10) Patent No.: US 9,157,713 B1
(45) Date of Patent: Oct. 13, 2015

(54) LIMITED RANGE RIFLE PROJECTILE

(71) Applicant: Alliant Techsystems Inc., Minneapolis, MN (US)

(72) Inventors: Bryan P. Peterson, Isanti, MN (US); Joshua L. Edel, East Bethel, MN (US); Lawrence P. Head, Cambridge, MN (US)

(73) Assignee: VISTA OUTDOOR OPERATIONS LLC, Clearfield, UT (US)

( * ) Notice: Subject to any disclaimer, the term of this patent is extended or adjusted under 35 U.S.C. 154(b) by 0 days.

(21) Appl. No.: 14/213,061

(22) Filed: Mar. 14, 2014

Related U.S. Application Data

(60) Provisional application No. 61/800,406, filed on Mar. 15, 2013.

(51) Int. Cl.

| | |
|---|---|
| ***F42B 10/32*** | (2006.01) |
| ***F42B 8/00*** | (2006.01) |
| ***F42B 8/12*** | (2006.01) |
| ***F42B 12/36*** | (2006.01) |

(52) U.S. Cl.
CPC ... *F42B 8/12* (2013.01); *F42B 8/00* (2013.01); *F42B 10/32* (2013.01); *F42B 12/36* (2013.01)

(58) Field of Classification Search
CPC ..... F42B 10/00; F42B 10/32; F42B 10/48; F42B 12/36; F42B 12/00; F42B 12/56; F42B 8/00; F42B 8/14; F42B 8/16; F42B 30/00
USPC ..... 102/439, 444, 498, 501, 502, 514–517, 102/529, 293
See application file for complete search history.

(56) References Cited

U.S. PATENT DOCUMENTS

| | | | | |
|---|---|---|---|---|
| 3,170,405 | A | 2/1965 | Jungermann et al. | |
| 3,508,493 | A * | 4/1970 | Olenick, Jr. | 102/491 |
| 3,747,533 | A | 7/1973 | Rossmann | |
| 4,063,511 | A | 12/1977 | Bullard | |
| 4,140,061 | A | 2/1979 | Campoli | |
| 4,153,223 | A | 5/1979 | Romer et al. | |
| 4,242,960 | A | 1/1981 | Boeder et al. | |
| 4,297,948 | A * | 11/1981 | Donovan | 102/473 |
| 4,334,478 | A | 6/1982 | Goes et al. | |
| 4,411,200 | A | 10/1983 | Brede et al. | |
| 4,413,566 | A | 11/1983 | Loeb et al. | |
| 4,519,316 | A | 5/1985 | Bethmann et al. | |
| 4,520,972 | A | 6/1985 | Diesinger et al. | |
| 4,596,191 | A | 6/1986 | Glotz et al. | |
| 4,607,810 | A | 8/1986 | Frazer | |
| 4,708,065 | A | 11/1987 | Schilling et al. | |
| 4,827,847 | A | 5/1989 | Laviolette et al. | |
| 4,905,602 | A | 3/1990 | Buckland | |
| H770 | H | 4/1990 | Kline et al. | |
| 4,936,218 | A | 6/1990 | Wosenitz | |
| 5,001,986 | A | 3/1991 | Meister | |

(Continued)

FOREIGN PATENT DOCUMENTS

| | | | |
|---|---|---|---|
| DE | 342 2659 | A1 | 12/1985 |
| EP | 0 036 231 | A1 | 9/1981 |

(Continued)

*Primary Examiner* — Jonathan C Weber
(74) *Attorney, Agent, or Firm* — Christensen Fonder P.A.

(57) ABSTRACT

Ammunition comprising bullets having destabilizing mechanisms that, under ballistic phase conditions, create instability in the bullets resulting in failure of the trajectory of the bullet and/or the sustainable velocity of the bullets.

11 Claims, 9 Drawing Sheets

(56) References Cited

U.S. PATENT DOCUMENTS

| | | | | |
|---|---|---|---|---|
| 5,035,183 | A | | 7/1991 | Luxton |
| 5,125,344 | A | | 6/1992 | Kline et al. |
| 5,279,787 | A | | 1/1994 | Oltrogge |
| 5,375,529 | A | | 12/1994 | Knight, Jr. et al. |
| 5,385,101 | A | | 1/1995 | Corzine et al. |
| 5,399,187 | A | | 3/1995 | Mravic et al. |
| 5,500,183 | A | | 3/1996 | Noordegraaf et al. |
| 5,665,808 | A | | 9/1997 | Bilsbury et al. |
| 5,932,836 | A | | 8/1999 | White |
| 6,016,754 | A | * | 1/2000 | Enlow et al. ..... 102/516 |
| 6,048,379 | A | | 4/2000 | Bray et al. |
| 6,123,289 | A | | 9/2000 | Manole et al. |
| 6,158,350 | A | | 12/2000 | Pulcini |
| 6,439,124 | B1 | | 8/2002 | Enlow et al. |
| 6,453,820 | B1 | | 9/2002 | Anderson |
| 6,536,352 | B1 | | 3/2003 | Nadkarni et al. |
| 6,629,669 | B2 | | 10/2003 | Jensen |
| 6,655,293 | B1 | | 12/2003 | Henry et al. |
| 6,983,700 | B1 | | 1/2006 | Malejko et al. |
| 7,412,930 | B2 | | 8/2008 | Smith et al. |
| 7,503,260 | B2 | | 3/2009 | Kapeles |
| 8,176,850 | B2 | | 5/2012 | Thompson et al. |
| 8,256,352 | B2 | | 9/2012 | Masinelli |
| 8,327,768 | B2 | | 12/2012 | Scarr |
| 2006/0027129 | A1 | | 2/2006 | Kolb et al. |
| 2006/0283314 | A1 | | 12/2006 | Cesaroni |

FOREIGN PATENT DOCUMENTS

| | | | |
|---|---|---|---|
| EP | 0 036 232 | A1 | 9/1981 |
| EP | 0 090 888 | A1 | 10/1983 |
| EP | 0 169 171 | B1 | 10/1988 |
| EP | 0 752 571 | A1 | 1/1997 |
| EP | 1 038 151 | B1 | 8/2005 |
| WO | WO 96/01407 | A1 | 1/1996 |
| WO | WO 99/13454 | A1 | 3/1999 |

* cited by examiner

LIMITED RANGE RIFLE PROJECTILE

CROSS-REFERENCE TO RELATED APPLICATIONS

This application claims the benefit of U.S. Provisional Patent Application No. 61/800,406, filed Mar. 15, 2013, the disclosure of which is incorporated herein by reference in its entirety.

FIELD OF THE INVENTION

The present invention is generally directed to a projectile that is adaptably fit within a casing of a cartridge for use with a firearm, wherein the projectile has a range limited trajectory characteristic which may be predetermined while providing realistic performance over a certain range for use with conventional firearms. More particularly, present invention is directed to mechanisms of the projectile that function to exhibit a tendency in the projectile to destabilize or otherwise limit downrange travel past a specific desired effective range.

BACKGROUND OF THE INVENTION

Standard caliber bullets have maximum ranges over distances of kilometers. However, firearm training ranges using such ammunition do not have such considerable area and rely on much shorter target ranges. The Department of Defense, military units, law enforcement and commercial range have specified rules of safety for ranges which require space far beyond the distance between shooter and target. This space not only includes the individual shooting ranges, but also safety fans or shortfall zones, parking areas, and various structures. However, government agencies and commercial entities typically are limited to their existing footprint, and therefore available ranges are limited. Department of Defense, military units, and law enforcement require rigorous training schedules. Limited range availability places constraint on these schedules. There is a desire to add more ranges, but the availability of the space that is required under safety guidelines is limited within the land footprints that are available.

It is desirable to develop and use bullets with limited range to accommodate the limited range area available.

It would further be desirable to provide a design for such ammunition which provides realistic training or recreational use at limited or enclosed ranges, but wherein the ammunition has a limited and predetermined range to increase the available arenas for training.

Accordingly, there is a need for projectiles that can be prepared to limit the effective range of the projectile while capable of maintaining realistic performance.

SUMMARY OF THE INVENTION

The present invention in some aspects relates to a rifle or other firearm projectile that exhibits a tendency to destabilize or otherwise limit downrange travel past a specific desired effective range under ballistic phase conditions allowing its use on ranges with limited space.

During firing or the "ballistic phase", as used herein, propellant is ignited and fired creating propellant combustion heat and the projectile travels through the rifled barrel of the firearm and engages the rifling of the barrel creating friction. The rifling imparts a spin to the projectile 10 such that the projectile 10 is spin stabilized once the projectile 10 leaves the barrel. The spinning creates extremely high centrifugal forces as spins can exceed 100,000 rpm. This spinning also creates considerable friction heat which is combined with the friction heat built up by forward progression. Internal friction built up by movement, if any, of the internal components of the projection also contributed to the heat generated during the ballistic phase. The ballistic phase, also referenced as external ballistics, extends from firing to the velocity termination or impact of the projectile. The "ballistic phase temperatures", as used herein, are those temperatures achieved during the ballistic phase. Contributing factors to the ballistic phase temperatures comprise the propellant combustion heat, rifling friction, centrifugal forces, spin friction, forward progression friction and internal movement friction. Ballistic phase temperatures of 320 C have been recorded on the sides of the projectile.

In some aspects, the present invention is directed to a projectile that has an aerodynamic body and is adapted for mounting in a cartridge case for firing with conventional firearms, such as rifles and handguns. The projectile incorporates low melting point (LMP) material and is constructed and arranged that, during the ballistic phase of a firing of said projectile, the LMP material melts, which initiates a destabilizing mechanism which alters the stability of the projectile during flight so as to create a catastrophic failure, or other similar destabilizing event, resulting in linear velocity loss.

In further aspects of the invention, the projectile employs a jacket, which may comprise standard copper-alloy common to many centerfire projectiles. The core may be lead-free, utilizing a tin-alloy core, selected based on melting point analysis and ballistic phase temperatures. Heat transfer within the internal ballistic phase of delivery is not adiabatic and leads to the heating of the tin-alloy. Skin friction during the exterior ballistic phase adds further heat to the core material. The tin-alloy at least partially melts and becomes a liquid in the jacket at some point downrange, and the ratio of axial to transverse moments of internal changes radically and affects the stability of the projectile.

In a further aspect of the invention, the same physical projectile composition noted above is used, except that the base of the jacket is formed with an aperture array comprising apertures to allow for 'shedding' of the melted core. Sectional density is reduced as mass is removed, leading to a projectile that exhibits a tendency to lose linear velocity at an accelerated rate due to loss of mass, thus limiting its effective range of flight.

The projectile, according to certain aspects of the present invention, comprises a core situated at least partially within a tubular cavity of the jacket. The core may at least partially form the nose of the projectile. The core may comprise a first core material and a second core material, wherein the melting point of the first core material is less than the melting point of the second core material. The first core material and the second core material may be substantially distinct and substantially linearly aligned along the longitudinal axis of the projectile with the first core material forming the first end of the core and the second core material forming the second end of the core. During the ballistic phase of a firing of the projectile, the first core material is at least partially discharged from the projectile through the plurality of apertures and/or from a position adjacent to the second end of the jacket due to melting of the first core material by heat generated during the ballistic phase and as a result thereof the second core material either 1) shifts toward the base of the bullet within and relative to the jacket along the longitudinal axis of the projectile or 2) separates from the jacket, causing projectile instability and linear velocity loss.

In some aspects, the second core material is slip-fitted into the end of the jacket, such that, during the ballistic phase of a firing of said projectile, the first core material is at least partially discharged from the projectile through the plurality of apertures due to melting of the first core material by heat generated during the ballistic phase. As a result, the second core material shifts toward the base relative to the jacket along the longitudinal axis of the projectile. This shortening of the bullet causes accelerated linear velocity loss.

In further aspects, an extending portion of the first core material extends noseward around the second core material between the jacket inner surface and the second core material at the position adjacent to the second end of the jacket, such that the second core material is not directly engaged with the jacket. During the ballistic phase of a firing of said projectile, the extending portion of the first core material is melted and at least partially discharged from the projectile causing the second core material to separate from the jacket. This results in catastrophic failure.

In some aspects of the invention, a first end of the jacket forms at least a portion of the base of the projectile. The jacket includes a plurality of apertures formed therein at the base. A core is situated at least partially within a tubular cavity of the jacket. The core comprises a first core material having a melting point that is no greater than ballistic phase temperatures. During the ballistic phase of a firing of said projectile, the first core material is at least partially discharged or shed from the projectile through the plurality of apertures due to melting of the first core material by heat generated during the ballistic phase. As a result thereof the projectile loses mass and has an accelerated loss of forward velocity.

In further aspects of the invention, the core at least partially forms the nose of the projectile. In addition to the core first material, the core further comprises a second core material distally situated from the first material and fixed to the jacket. The melting point of the first material is less than the melting point of the second core material. The first core material and the second core material are substantially distinct and substantially linearly aligned along the longitudinal axis of the projectile with the first material forming the first end of the core and the second core material forming the second end of the core. During the ballistic phase of a firing of said projectile, the first material is at least partially discharged from the projectile through plurality of apertures due to melting of the first material by heat generated during the ballistic phase. As a result thereof, the center of gravity of the projectile moves adjacent to or forward of the center of pressure causing the projectile to become unstable and lose linear velocity.

In still further aspects of the invention, the second end of the jacket may at least partially form the nose of the projectile. The tubular cavity formed by the jacket comprises an open cavity portion between the core, which is position toward the base, and the nose along the longitudinal axis of the projectile. The core may comprise at least one channel formed in the first material. The channel is longitudinal aligned relative to the longitudinal axis of the projectile and opens at an end into the open cavity portion. The channel may be positioned radially within the first material. The channel may also or instead of be positioned between the first material and the inner surface of the jacket. Additionally, a portion of the jacket which is positioned radial around the first material of the core may increase in thickness in the direction of nose to base.

In another aspect of the invention, the jacket may form at least a portion of the base of the projectile and at least partially forms the nose of the projectile. The projectile further comprises a core situated at least partially within the tubular cavity of the jacket. The core is an elongated body with a first end at the base of the projectile, a second end, and an outer surface in engaged contact with the inner surface of the jacket. The core comprises a first core material having a melting point that is no greater than ballistic phase temperatures. Additionally, the tubular cavity of the jacket comprises an open cavity portion between the core and the nose along the longitudinal axis of the projectile. The projectile is so arranged and constructed that, during the ballistic phase of a firing of said projectile, the outer surface first material of the core disengages from the inner surface of the jacket due to melting of the outer surface of the first material by heat generated during the ballistic phase. As a result thereof, the core becomes freely moving within the jacket causing the center of gravity of the projectile to move noseward adjacent to the center of pressure. This causes the projectile to become unstable and lose linear velocity. In certain aspects of the invention, the core may be conical in shape with an apex directed toward the nose. In further aspects, the first material of the core may comprise an irregular outer surface such that the outer surface is not flush with the inner surface of the jacket. Also or alternatively, the inner surface of the jacket is irregular such that it is not flush with the outer surface of the first material of the core. Irregularities may include, but are not limited to, ribs/rails, bumps, surface depressions and/or channels on either interfacing surface.

In some aspects of the invention, the projectile may comprise a jacket, wherein the inner surface of the jacket defines a tubular cavity and wherein the first end of the jacket forms at least a portion of the base of the projectile and the second end of the jacket at least partially forms the nose of the projectile. The projectile further comprises a core situated at least partially within the tubular cavity of the jacket with a first end at the base of the projectile. The may comprises a material that has a melting point that is no greater than ballistic phase temperatures. The projectile further comprises an insert having a first end aligned toward the base and a second end aligned toward the nose. The insert has an outer surface with a melting point greater than the melting point of the first material. The insert may be positioned at least partially radially within the first material and is thereby engaged to the first material at an interface between the first materials and the insert. During the ballistic phase of a firing of said projectile, the insert of the core at least partially disengages from the first material due to melting of the interface between the first material and the insert by heat generated during the ballistic phase. As a result thereof, the insert becomes misaligned with the axis of the projectile and the center of gravity of the projectile is offset causing accelerated loss of forward velocity.

In certain aspects of the invention, the insert extends beyond the second end of the first material toward the nose. In further aspects, the insert is radially fully within the first material. In other aspects, the first material extends with the jacket to the nose. In these aspects, the jacket may comprise an open cavity portion between the core and the nose along the longitudinal axis of the projectile. In further aspects, such open cavity may be filled with a rigid second material.

In still further aspects and embodiments of the invention, the projectile may comprise a jacket and a core therein. The jacket includes an aperture array, which is one or more apertures formed in its containing wall, wherein total open area defined by all of the one or more apertures is asymmetrically spaced around the longitudinal axis of the projectile. The core comprises first material situated at least partially within a tubular cavity of the jacket and being adjacent to the one or more apertures. The first material has a melting point that is no greater than ballistic phase temperatures resulting from firing said projectile. During the ballistic phase of a firing of said projectile, the first material is at least partially discharged from the projectile through the one or more apertures due to melting of the first material by heat generated during the ballistic phase. As a result, the projectile becomes unstable causing accelerated loss of forward velocity.

In all aspects and embodiments of the invention, an aperture array may be employed at the base of the projectile. The aperture array comprises one or more apertures which increase exposure of the first material to ballistic temperatures and allows shedding. In all aspects and embodiments of the invention, the aperture array is such that the total open area defined by all of the one or more apertures is asymmetrically spaced around the longitudinal axis of the projectile.

An embodiment of the present invention may include a cartridge with range limiting, the cartridge comprising a casing with a cavity, a projectile receiving end, propellant in the casing, and a projectile received in the projectile receiving end. The projectile may comprise a projectile jacket and a core, the projectile having a forward portion with an ogive shape and a rearward portion with a generally cylindrical or tapered cylindrical shape and having a bearing surface for engaging the rifling in a barrel. The projectile includes means for causing delayed instability from the heating of the projectile from the engagement of the bearing surface with the rifling in a barrel upon firing of the cartridge. The means includes utilizing a core material that melts upon firing due to the friction heating by the bearing surface engaging with the rifle barrel upon firing. The means for causing delayed instability from the heating of the projectile may further comprise having core leakage ports defined around a circumference of the projectile, whereby the core material can leak from the leakage ports after firing. The core leakage ports may further comprise one of the group comprising slits in the jacket, openings in the jacket, whereby the core is exposed, and localized thinned regions of the jacket, wherein the thinned region is at least 50% thinner than at an adjacent non thinned region.

The inventions disclosed herein may include a cartridge having a means for causing delayed instability, wherein the means comprises a shiftable mass inside the bullet jacket that is released upon melting of a quantity of the core material and may then change internal positions causing the instability.

The inventions disclosed herein may include a cartridge having a means for causing delayed instability, wherein the means comprises a shiftable mass that is released upon melting of a quantity of the core material and may then change positions causing the instability.

The inventions disclosed herein may include a cartridge having a means for causing delayed instability, wherein the means comprises a shifting the center of mass of the bullet closer to the center of pressure of the projectile due to melting of a quantity of the core material.

An embodiment of the present invention may include a cartridge with range limiting, the cartridge comprising a casing with a cavity, a projectile receiving end, propellant in the casing, and a projectile received in the projectile receiving end. The projectile may comprise a projectile jacket and a core, the projectile having a forward portion with an ogive shape and a rearward portion with a generally cylindrical or tapered cylindrical shape and having a bearing surface for engaging the rifling in a barrel. The projectile may have a quantity of meltable material in the core that will progressively melt due to the transfer of heat from the exterior surface of the projectile inwardly after the bullet is fired and the bullet travels downrange. The jacket may include core leakage ports defined around a circumference of the projectile whereby the core material can leak from the leakage ports after firing. The core leakage ports may comprise one of a group comprising slits in the jacket, openings in the jacket, whereby the core is exposed, and localized thinned regions of the jacket, wherein the thinned region is at least 50% thinner than at an adjacent non thinned region. The projectile may include a shiftable mass inside an interior of the projectile that is initially fixed in position and then is released upon melting of a quantity of the core material and may then change internal positions causing the instability.

The inventions disclosed herein may include a cartridge comprising a quantity of material, wherein a progressive melting of the quantity of material causes a shifting of the center of mass of the bullet closer to the center of pressure of the projectile due to melting of a quantity of the core material.

The inventions disclosed herein may include a cartridge comprising a projectile disclosed herein securely fitted therein, wherein the cartridge is unfired and suitable for use in a hand held firearm.

The aspects and embodiments of the present invention are advantageous to Department of Defense, foreign ministry, law enforcement, and commercial ranges that have limited-range, or desired to add more ranges within their existing footprint. The limited range projectiles disclosed herein allow for a smaller safety fan, thus allowing for rifle-fire at certain ranges that have been unavailable in the past and for the establishment of new ranges on land that would have otherwise been unsuitable.

The aspects and embodiments of the present invention are advantageous because they allow for increased utilization of training range space by reducing the maximum ballistic range of rifle munitions. They further allow users to maintain rigorous training schedules due to increased efficiency and utilization of range space. The limited range projectiles disclosed herein allows for rifle-fire at certain ranges that have been closed to it in the past. Further additional ranges having limited range area may be opened due to reduced size of tracts of land required.

The aspects and embodiments of the present invention are advantageous because they provide a design for limited range ammunition which provides realistic training or recreational use at limited or enclosed ranges.

The aspects and embodiments of the present invention are advantageous due to the simplicity of design allowing for reduced costs.

The above summary of the various representative aspects of the invention is not intended to describe each illustrated aspect or every implementation of the invention. Rather, the aspects are chosen and described so that others skilled in the art can appreciate and understand the principles and practices of the invention. The figures in the detailed description that follow more particularly exemplify these aspects.

Still other objects and advantages of the present invention and methods of construction of the same will become readily apparent to those skilled in the art from the following detailed description, wherein only the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawing and description are to be regarded as illustrative in nature, and not as restrictive.

BRIEF DESCRIPTION OF THE DRAWINGS

The invention can be completely understood in consideration of the following detailed description of various aspects of the invention in connection with the accompanying drawings, in which.

Figure 1A:
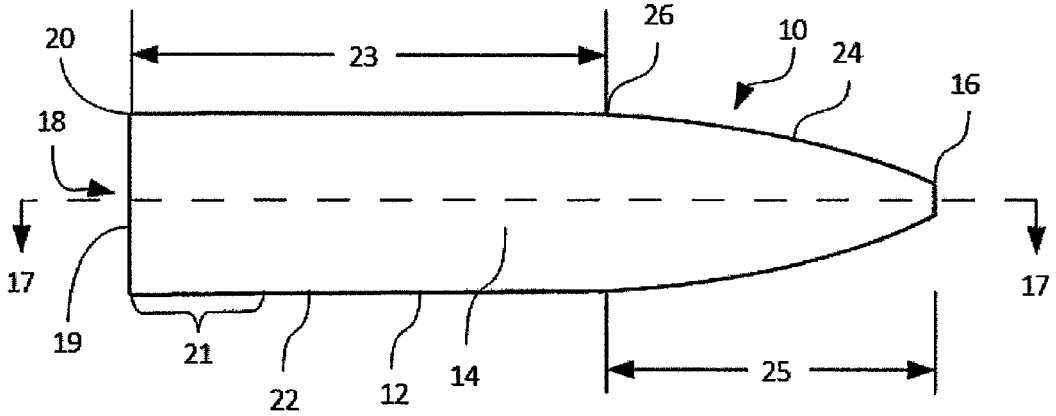
FIGS. 1A-1B are side views of a projectile according to certain aspects of the present invention.

While the present invention is amenable to various modifications and alternative forms, specifics thereof have been shown by way of example in the drawings and will be described in detail. It should be understood, however, that the intention is not to limit the present invention to the particular aspects described. On the contrary, the intention is to cover all modifications, equivalents, and alternatives falling within the spirit and scope of the present invention as defined by the appended claims.

DETAILED DESCRIPTION OF THE DRAWINGS

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 1B:
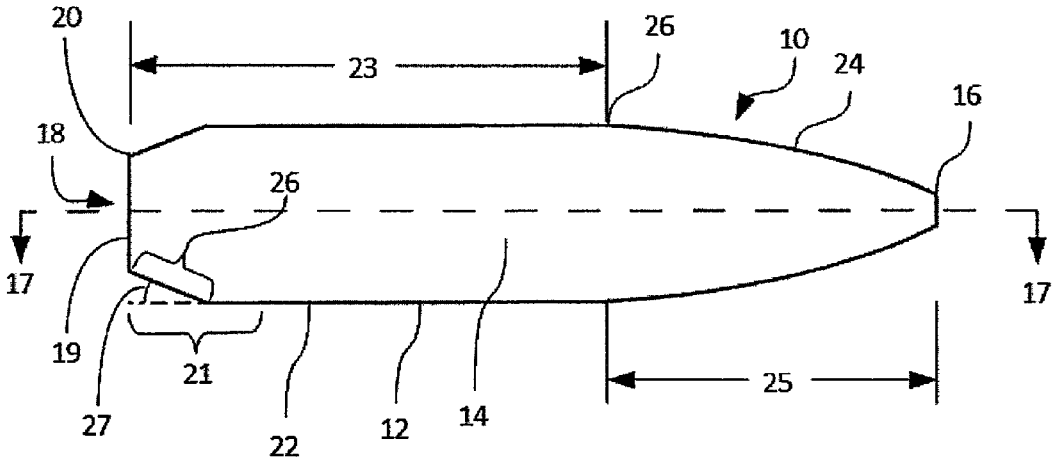

The invention is directed to projectiles and methods to produce the inventive projectiles. FIGS. 1A and 1B are side views illustrating general aspects of the present invention. As seen in FIG. 1A, a projectile 10, according to an aspect of the present invention comprises an outer surface portion 12, which may comprise partially or entirely a jacket, and an inner core 14 (unseen in these figures), which may account for a portion of the outer surface. The projectile 10 further comprises a nose 16 defining the front end of the projectile 10 and a base 18 defining the rear end of the projectile 10. The base 18 is considered to comprise a bottom base 19, which comprises a portion which is general perpendicular to the longitudinal axis 17 of the projectile 10, a heel portion 20, and a side base 21, which extends forward from the heel portion 20. An alternative heel portion 20 is shown in FIG. 1B. Such a base heel design is generally known as a boat-tail. For the embodiments and aspects of the invention illustrated herein, such heel designs may be utilized with varying boat-tail angles 27 and varying boat-tail lengths 28.

The general aspects of the present invention further comprise a bearing surface 22 having a bearing length 23 situated between the base heel 20 and a shoulder 26. The invention further comprises an ogive portion 24 having an ogive length 25.

Figure 2:
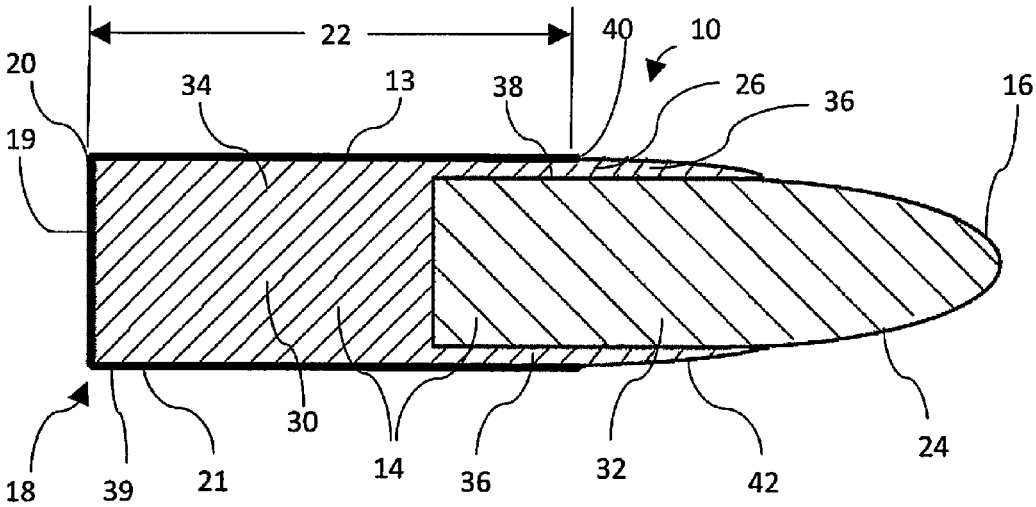
FIG. 2 is a cross-sectional side view of the projectile according to certain aspects of the present invention.

FIG. 2 is a longitudinal cross-section view along the axis 17 of a projectile of the present invention illustrating certain aspects of the present invention. A projectile 10, according to an aspect of the present invention, comprises a jacket 13 and a core 14, wherein the core 14 comprises a first material 30 and a second material 32. In the embodiment shown, the first material substantially fills the base portion 18 of the jacket extending from a first end 39 of the jacket noseward in the jacket cavity 34. The second material 32 is stacked on the first material 30 and extends noseward 16 from within a portion of the jacket 13 forming the nose 16 of the projectile. Extending portions 36 of the first material 30 extend up the side walls 38 of the second material 32, between the jacket 13 and the second material 32, and optionally beyond the noseward or second end 40 of the jacket to form an exposed portion 42 of the first material 30.

For this aspect of invention, as well as all other aspects and embodiments of the present invention, suitable materials for the first material 30 of the core material are materials and compositions having a melting point that is no greater than ballistic phase temperatures resulting from firing said projectile after adapting it into a cartridge and preparing it into a condition for firing. Such first materials may include, but are not limited to, tin and tin alloys.

For this aspect of invention, as well as other aspects, suitable materials for the second material 32 of the core material are materials and compositions having a melting point that is equal to or greater than ballistic phase temperatures resulting from firing said projectile after adapting it into a cartridge and preparing it into a condition for firing. Such second materials may include, but are not limited to, any rigid material suitable for use as ballistic projectiles.

In this aspect of the invention, the projectile 10 is so arranged and constructed that, during the ballistic phase of a firing of the projectile 10, barrel and air friction and any other conditions included in the ballistic phase and the accompanying ballistic phase temperatures melt and/or loosens the extending portion 38 and exposed portion 36 of the first material 30 between the jacket 13 and the second material 32. In this process, the first material may be at least partially discharged from the projectile from a position adjacent to the second end 40 of the jacket 13. This releases and disengages the second material 32 from the jacket 13 leading to an expected catastrophic failure of the projectile 10 at a predetermined range. The projectile becomes unstable and has accelerated linear velocity loss. The predetermined range may be set by the determination of the melting point of the first material 30 and various dimensional parameters.

For this aspect of invention, as well as other aspects and embodiments, the projectile may further comprise an aperture array in the base 18 of the projectile 10. If the jacket 13 forms the base 18, as in the present embodiment of FIG. 2, then the aperture array is in the jacket 13. The aperture array comprises one or more apertures 29 that expose the first material 30 to the ballistic phase temperatures without any substantive interface layer between the two. The apertures may take the form of openings such as holes, cuts or open channels, wherein the first materials 30 are directly exposed, or the apertures may take the form of a thin layer of material which quickly burn away under ballistic conditions and would not be a substantive interface layer. The apertures are constructed and arranged so as to allow for the shedding or bleeding of first material 30 during the ballistic phase due to flight dynamics, including centrifugal forces due to projectile spin. The apertures in the aspects of the invention may be located in and around the base 18 of the projectile, typically in the first end 39 of the jacket.

Figure 3A:
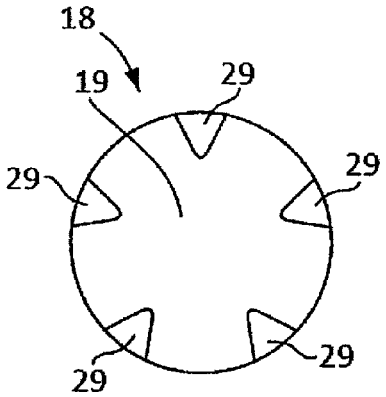
FIG. 3A is a bottom view of a projectile according to certain aspects of the present invention.
Figure 3B:
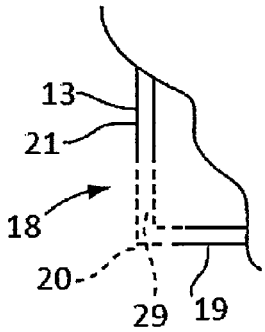
FIG. 3B is cross-section cut away view of a projectile according to certain aspects of the present invention.
Figure 3C:
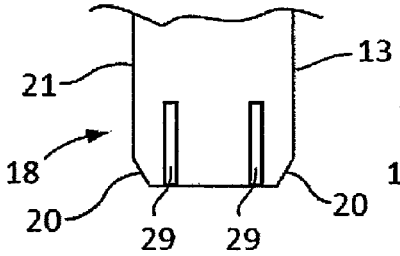
FIGS. 3C-3D are side cut away views of a projectile according to certain aspects of the present invention.
Figure 3D:
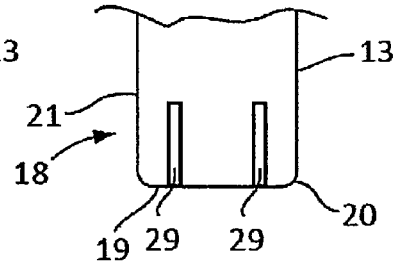

FIGS. 3A-3D are cut away views of aspects of the base 18 of the present invention illustrating aspects of the aperture array as part of the embodiment shown in FIG. 2 and of other embodiments and aspects of the invention as described herein. As seen in FIG. 3A, the invention may have a plurality of apertures 29 formed in the base 18 (jacket 13). FIG. 3A shows a bottom base 19 of a base 18 of a projectile 10. Apertures 29 are formed therein, exposing the first material 30. FIG. 3B is a cross-section view illustrating how the apertures 39 may extend from the bottom base 19, around the heel 20, and up the side base 21. FIG. 3C illustrates a boat-tail base 18 wherein the apertures may extend along the boat-tail heel 20 and up the side base 21. FIG. 3D illustrates how the apertures 29 may extend from the heel 20 up the side base 21. The present invention also contemplates for this aspect of invention, as well as all other aspects and embodiments, one or more apertures formed in the base 18 (jacket 13), wherein the total open area defined by all of the apertures is asymmetrically spaced around the longitudinal axis of the projectile 10. A single aperture or aperture array may be centrally located in the bottom base 19. A single aperture or aperture array may be located in the bottom base 19 and position off center.

Figure 4A:
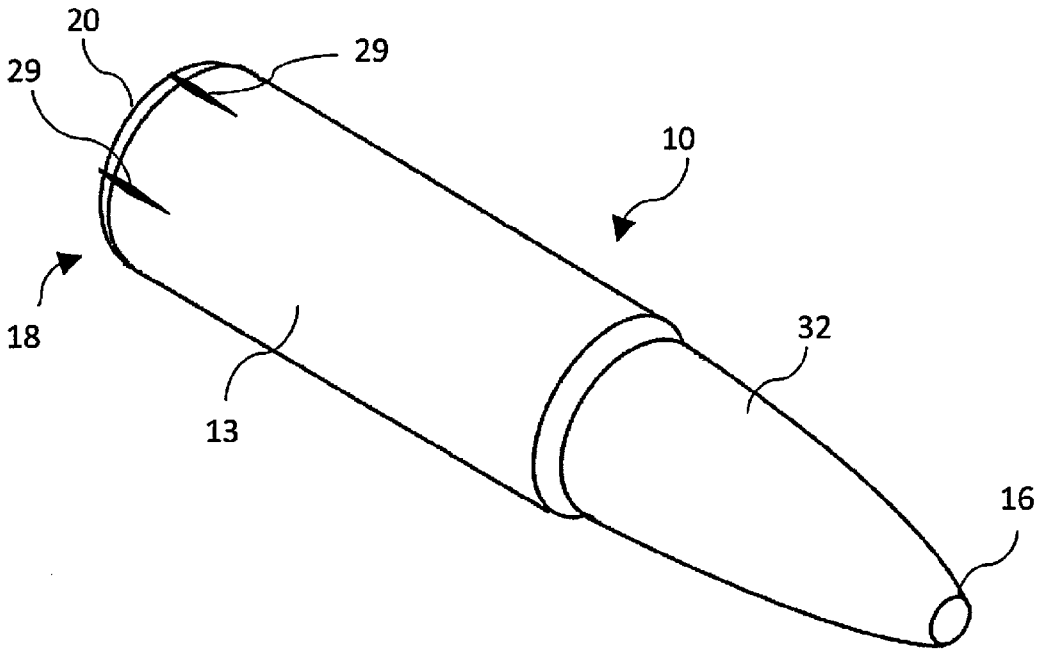
FIG. 4A is a perspective view of a projectile according to certain aspects of the present invention.
Figure 4B:
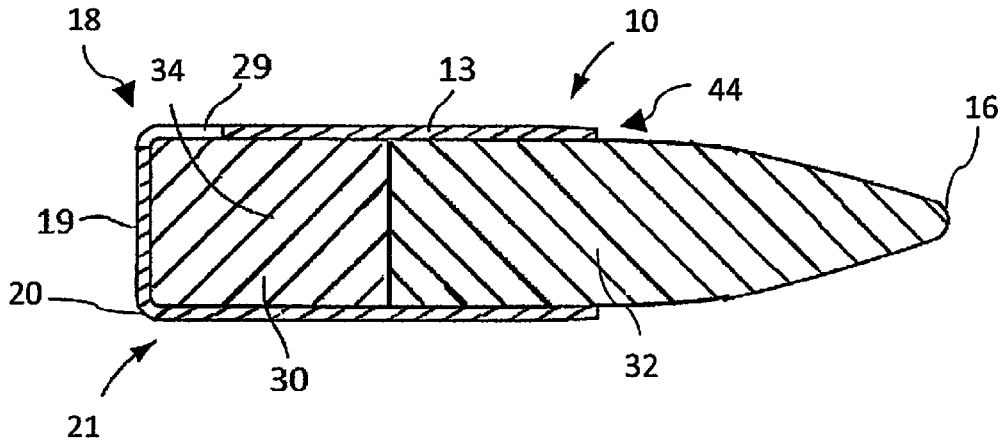
FIGS. 4B-4C are cross-sectional side views of the projectile according to certain aspects of the present invention.
Figure 4C:
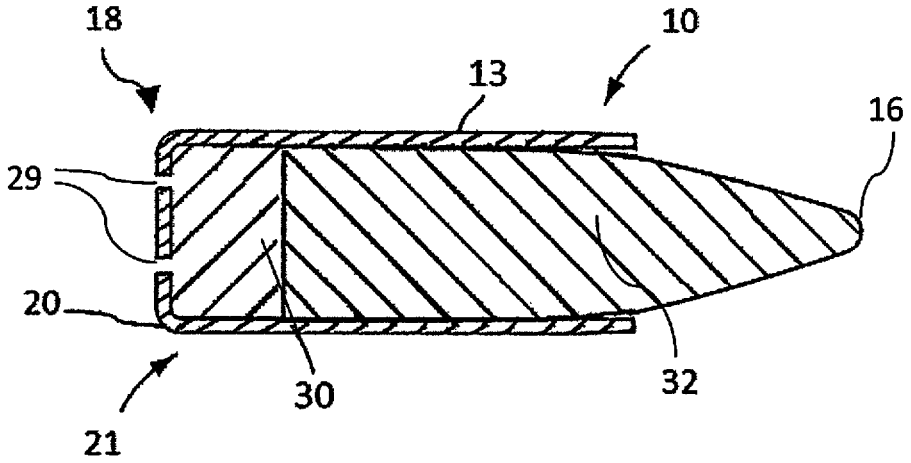

In an aspect of the invention as shown in FIGS. 4A-4C, the second material 32 is slip fit in and engages the jacket, as generally shown at 44, such that the second material 32 is slideably engaged with the jacket 13. The second material 32 is longitudinally stacked on the first material 30, which is fitted in the jacket cavity 34 at the base 18, as shown in FIG. 4B. Upon firing of the projectile, the environment of the ballistic phase melts the first material 30, which then sheds and evacuates the jacket via apertures 29, shown as radial slots in the jacket at the base 18. This process is aided by the extremely high centrifugal forces during the ballistic phase. As the first material 30 is removed, the second material 32 slides baseward/rearward into the jacket as space is created by the first material 30 evacuation. This leads to a shortening of the projectile and a marked decrease in ballistic performance due to the reduction in aerodynamic profile. FIG. 4C illustrates the projectile 10 in a shortened state.

Figure 5A:
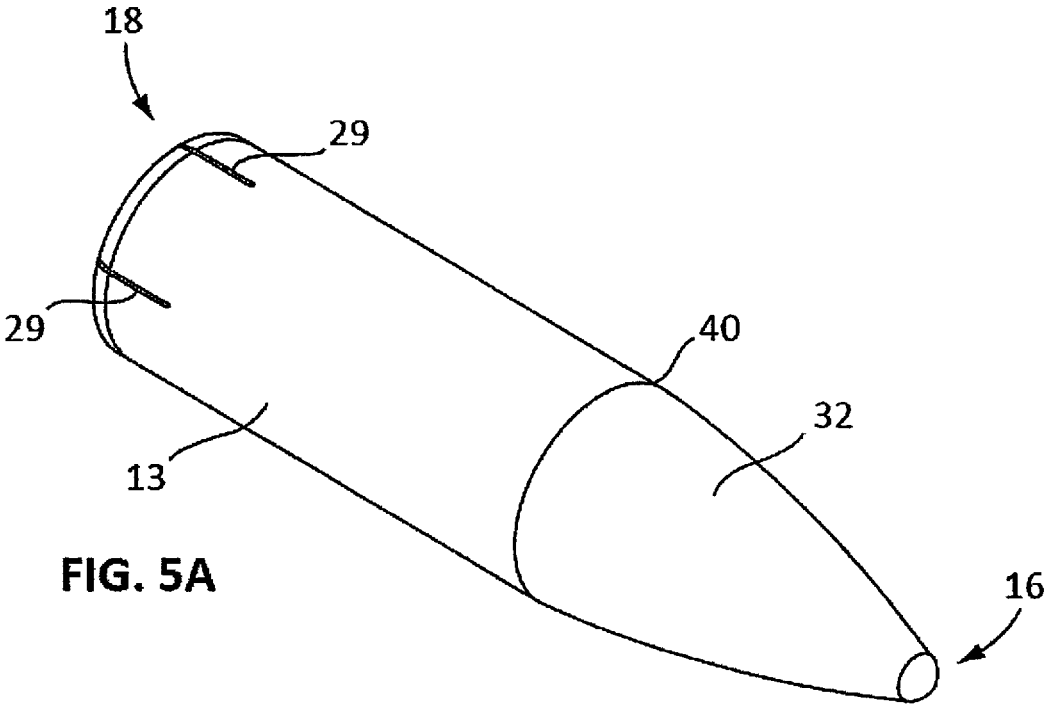
FIG. 5A is a perspective view of a projectile according to certain aspects of the present invention.
Figure 5B:
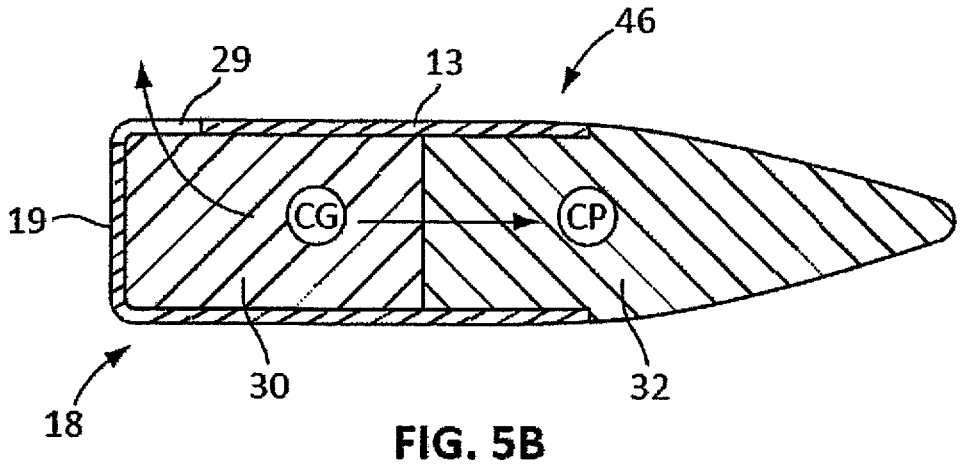
FIG. 5B is a cross-sectional side view of the projectile according to certain aspects of the present invention.

In an aspect of the invention as shown in FIGS. 5A-5B, the second material 32 is fit in and fixed to the jacket, as generally shown at 46, such that the second material 32 is in a fixed position relative to the jacket 13. The second material 32 is longitudinally stacked on the first material 30, which is fitted in the jacket cavity 34 at the base 18, as shown in FIG. 5B. Upon firing of the projectile, the environment of the ballistic phase melts the first material 30, which then sheds and evacuates the jacket via apertures 29, shown as radial slots in the jacket at the base 18. This process is aided by the extremely high centrifugal forces during the ballistic phase. As the first material 30 is removed creating an open cavity in place of the first material 30, the center of gravity (CG) of the projectile 10 moves adjacent to or forward of the center of pressure (CP) of the projectile causing the projectile to become unstable and lose linear velocity.

Figure 6A:
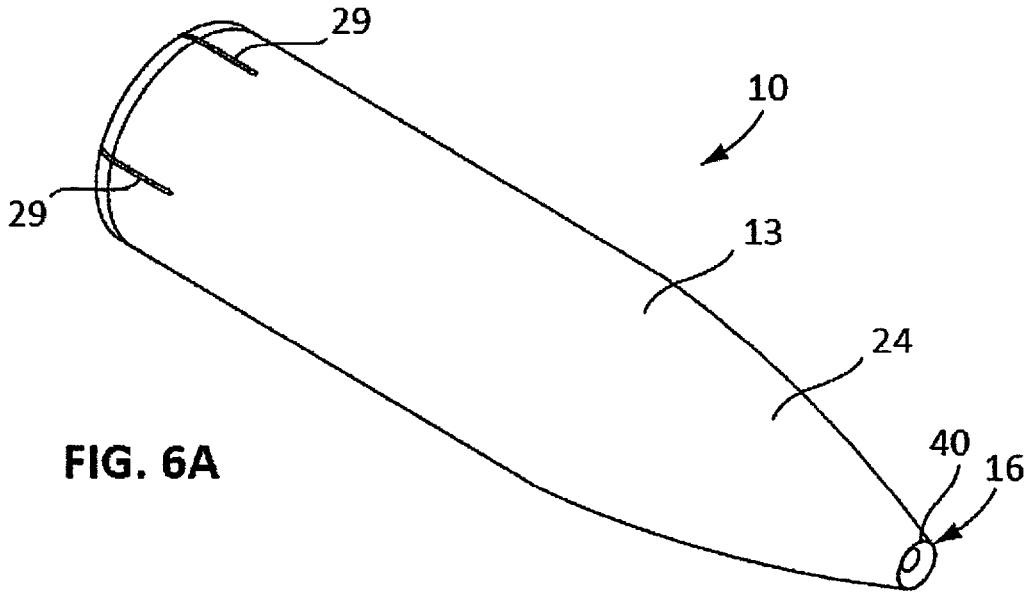
FIG. 6A is a perspective view of a projectile according to certain aspects of the present invention.
Figure 6B:
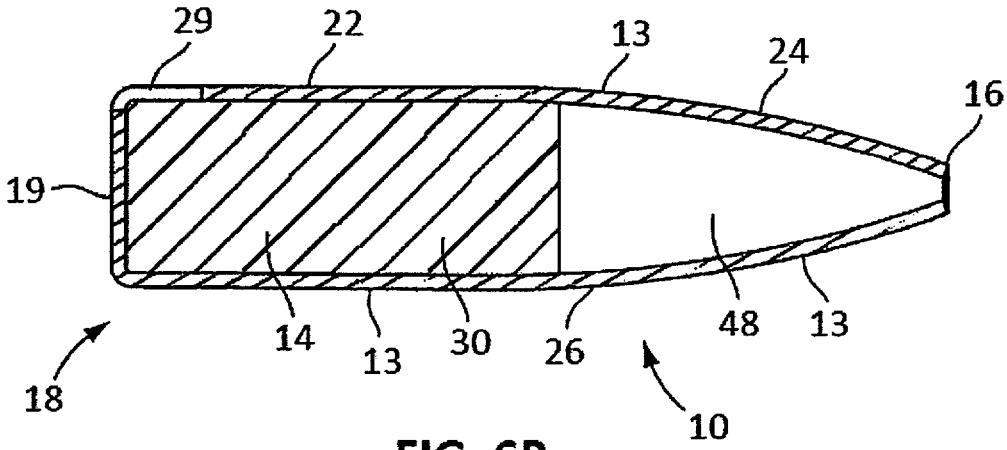
FIGS. 6B-6C are cross-sectional side views of the projectile according to certain aspects of the present invention.

In an aspect of the invention as shown in FIGS. 6A-6B, the jacket 13 extends noseward, such that the jacket 13 forms the outer surface of the ogive 24 and the second end 40 of the jacket 13 at least partially forms the nose 16 of the projectile 16. The core 14 comprises the first material 30. The jacket 13 at the ogive 24 comprises an open cavity portion 48 between the core 14 and the nose 16 along the longitudinal axis 17 of the projectile 10.

In this aspect of the invention, the first material 30 is fitted in the jacket cavity 34 at the base 18, as shown in FIG. 6B. The first material may extend noseward substantially the length of the bearing length 23 adjacent the shoulder 26. Upon firing of the projectile, the environment of the ballistic phase melts the first material 30, which then sheds and evacuates the jacket via apertures 29, shown as radial slots in the jacket at the base 18. This process is aided by the extremely high centrifugal forces during the ballistic phase. As the first material 30 is removed, the sectional density of the projectile 10 decreases as mass is lost, leading to an accelerated loss of forward velocity due to loss of mass.

Figure 6C:
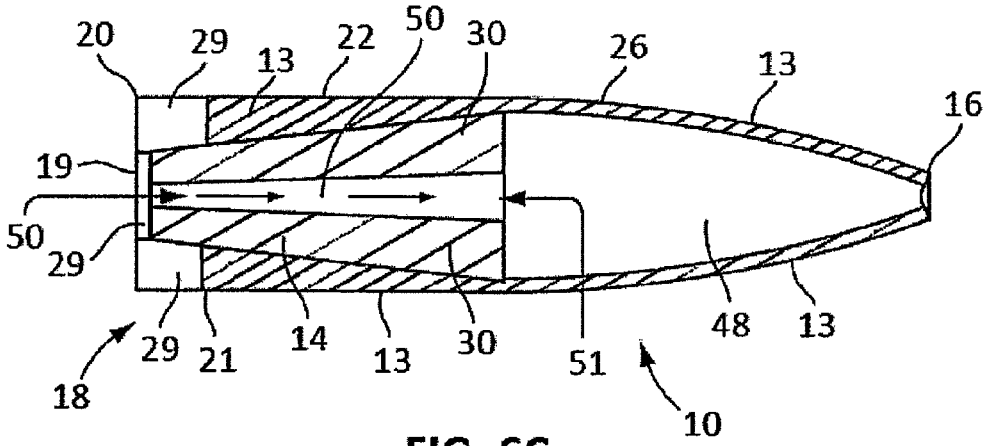

In a further aspect of the invention, as show in FIG. 6C, the radial jacket 13 thickness may be gradually thickened in the baseward direction starting adjacent to the shoulder 26 to the heel 20. Also as shown in FIG. 6C, a further aspect, which may be incorporated with or without the thickening jacket, may include a core 14 comprising the first material 30, wherein the first material includes a channel or conduit 50 formed therein longitudinal aligned relative to the longitudinal axis 17 of the projectile 10 and opening 51 at its noseward end into the open cavity portion 48 of the projectile. In this embodiment, the projectile may include apertures at the heel 20 extending up the base side 21 and/or an aperture 29 centrally positioned through the bottom base 19 in fluid communication with the conduit 50.

Figure 7A:
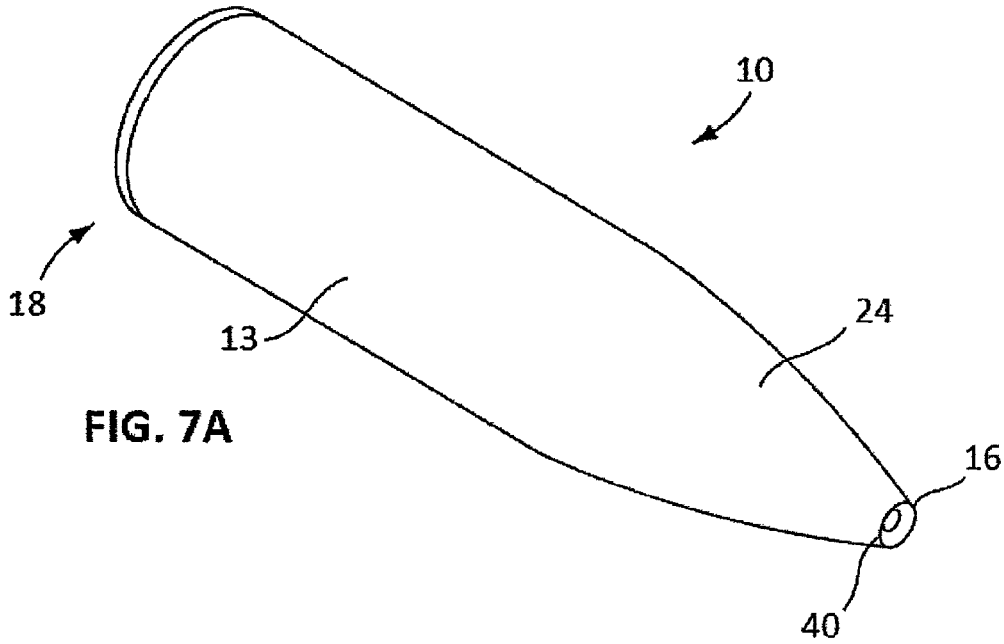
FIG. 7A is a perspective view of a projectile according to certain aspects of the present invention.
Figure 7B:
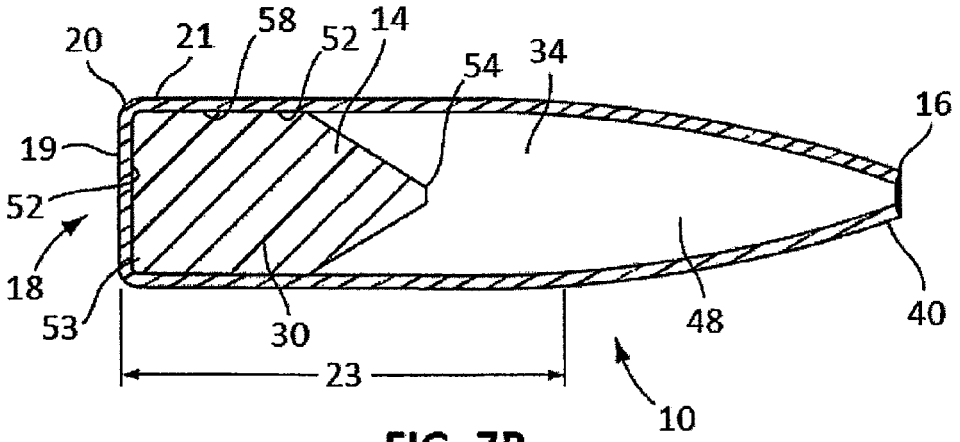
FIG. 7B is a cross-sectional side view of the projectile according to certain aspects of the present invention.

In a further aspect of the invention as shown in FIGS. 7A-7B, the jacket 13 extends noseward, such that the jacket 13 forms the outer surface of the ogive 24 and the second end 40 of the jacket 13 at least partially forms the nose 16 of the projectile 16. The core 14 comprises the first material 30. The jacket 13 at the ogive 24 comprises an open cavity portion 48 between the core 14 and the nose 16 along the longitudinal axis 17 of the projectile 10.

In this aspect of the invention, the first end 53 of first material 30 is fitted in the jacket cavity 34 at the base 18, as shown in FIG. 7B, in contact with the inner surface 52 of the jacket 13 at the base 18. The first material may extend noseward a portion of the length of the bearing length 23. In some aspect of the invention, the second material extends no more the about ⅔ of the bearing length 23 from the heel 20. In this aspect of the invention, the projectile 10 comprises an open cavity 48 portioned between the core 14 and the nose 16 along the longitudinal axis of the projectile. Upon firing of the projectile, the environment of the ballistic phase and the heat of the jacket 13 material melt the outer surface of the first material 30 immediately adjacent to and/or in contact with the inner surface 52 of the jacket. As a result, the outer surface first material 30 of the core 14 disengages from the inner surface 52 of the jacket 13 and the core becomes freely moving within the jacket. As the projectile 10 slows due to the opposing forces of atmospheric conditions, the freed core 14, which is shielded by the jacket from such forces, moves noseward and, in some cases, about the jacket cavity, resulting in the CG to move adjacent to or forward the CP. This creates an unstable spin-stabilized projectile configuration, causing accelerated loss of linear velocity.

In a further aspect of the invention, as show in FIG. 7B, the second end 54 of the core 14 is conical in shape with an apex 56 directed toward the nose 16. When the core 14 is freed in the ballistic phase, the core 14 slides toward the nose 16 within the jacket 13. It is contemplated in the present invention that the core 14 may be in various shapes that may be fixed inside the jacket 14 and released under the characteristics of the ballistic phase.

In a further aspect of the invention, it is contemplated that the interface/contact area 58 between the inner surface 52 of the jacket 13 and the core 14 may be varied to control the limited range of the projectile. This may be done by varying the interface 58 by varying the contact between the inner surface 52 of the jacket 13 and the outer surface of the core 14 that confronts the inner surface 52 such that they are not flush, thereby reducing or increasing the interface 58 area. In certain aspects of the invention, this is achieved by forming irregularities in the inner surface 52 of the jacket 13 and/or the outer surface of the core 14. Irregularities including, but are not limited to, ribs/rails on the inner surface 52 and/or channels or ribs/rails on the outer surface of the core 14 that are aligned with the axis 17, bumps on either surface, surface depressions on the outer surface of the core 14, or the like.

Figure 8A:
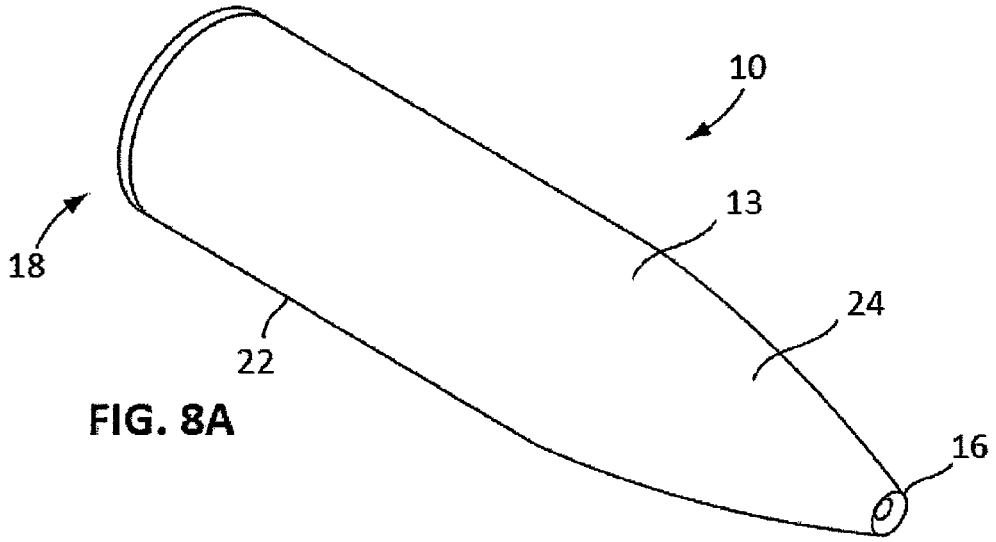
FIG. 8A is a perspective view of a projectile according to certain aspects of the present invention.
Figure 8B:
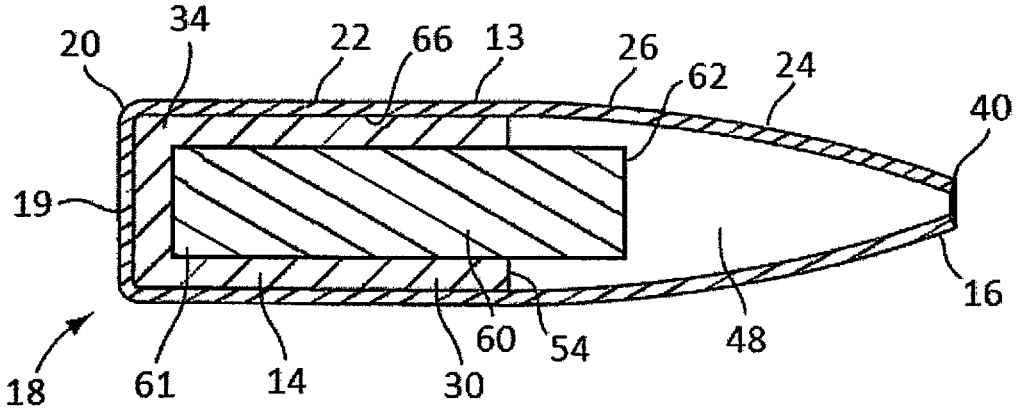
FIGS. 8B-8D are cross-sectional side views of the projectile according to certain aspects of the present invention.

In further aspects of the invention as shown in FIGS. 8A-8D, as shown in FIG. 8B the jacket 13 extends noseward, such that the jacket 13 forms the outer surface of the ogive 24 and the second end 40 of the jacket 13 at least partially forms the nose 16 of the projectile 16. The core 14 comprises the second material 30. The jacket 13 at the ogive 24 comprises an open cavity portion 48 between the core 14 and the nose 16 along the longitudinal axis 17 of the projectile 10.

In this aspect of the invention, the first end 53 first material 30 is fitted in the jacket cavity 34 at the base 18, as shown in FIG. 6B. The first material may extend noseward substantially the length of the bearing length 23 with the second 54 of the first material 30 confronting the open cavity 48 adjacent the shoulder 26. In a further aspect of this embodiment, as show in FIG. 8B, the core 14 further comprises an insert 60, wherein, in this aspect of the invention, is shaped like a rod. The insert 60 may comprise any suitable material including, but not limited to, rigid polymer material and any rigid metallic material suitable for use as ballistic projectiles. The insert 60 includes a first end 61 aligned toward the base 18 and a second end 62 aligned toward the nose 16. The insert has an outer surface 64 with a melting point that is greater than the melting point of the first material 30 and the first core material 30 and the insert 60 material being substantially distinct. The insert 60 is linearly aligned with the projectile axis 17 and is positioned at least partially radially within the first material 30 and is thereby engaged to the first material 30 at an interface between the first materials 30 and the insert 60. In the embodiment shown in FIG. 8B, the second end 62 of the insert 60 extends from the second end 54 of the first material 54 into the open cavity 48 of the projectile 10.

Upon firing of the projectile, the environment of the ballistic phase melts the thin interface 66 between the jacket 13 and insert 60, leading to catastrophic angle of attack failure at a pre-determined range due to a dramatic CG offset as the core axis becomes misaligned with the projectile axis 17, leading to an accelerated loss of forward velocity.

Figure 8C:
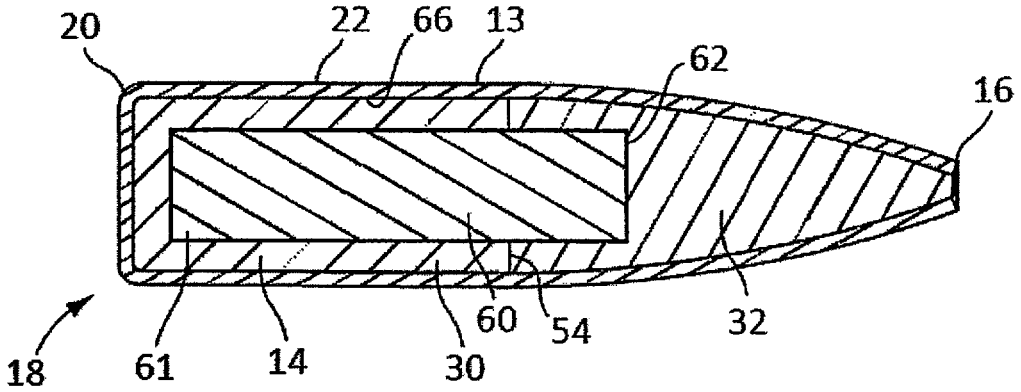

In certain aspects of the invention, as shown in FIG. 8C, the core 14 further comprises second material 32. In such embodiments, the insert 60 is entirely engulfed and the open cavity 48 shown in FIG. 8B may be substantially filled with second material 32, wherein the second end 62 of the insert 60 extends into the second material 32.

Figure 8D:
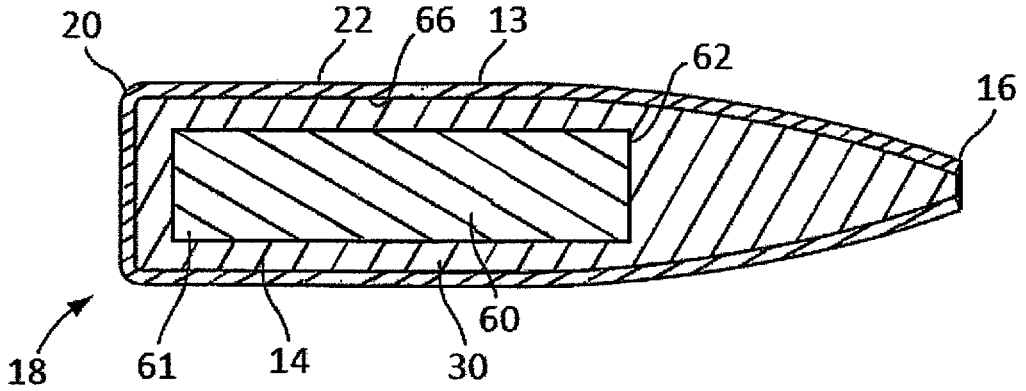

In certain aspects of the invention, as shown in FIG. 8D, the insert 60 is entirely engulfed in and fully within first material 30 and the open cavity 48 shown in FIG. 8B may be substantially filled with first material 30.

For this aspect of invention shown in FIGS. 8A-8D, the projectile may further comprise an aperture array in the base 18.

In some aspects of the invention, the insert 60 may be various shapes that may be linearly aligned and balanced along an axis and not necessarily a cylindrical rod of constant diameter. The insert 60 may be of various lengths.

Figure 9A:
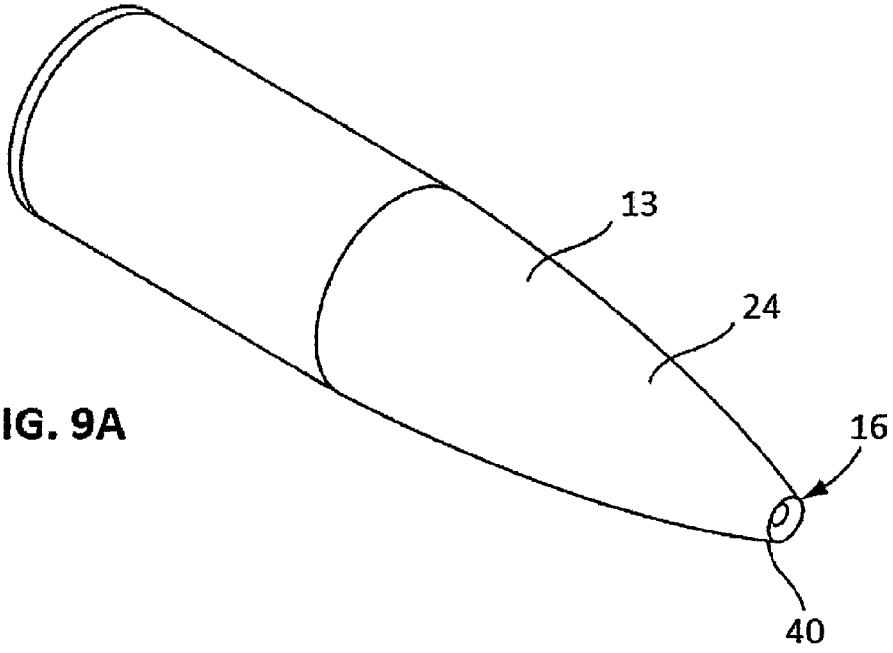
FIG. 9A is a perspective view of a projectile according to certain aspects of the present invention.
Figure 9B:
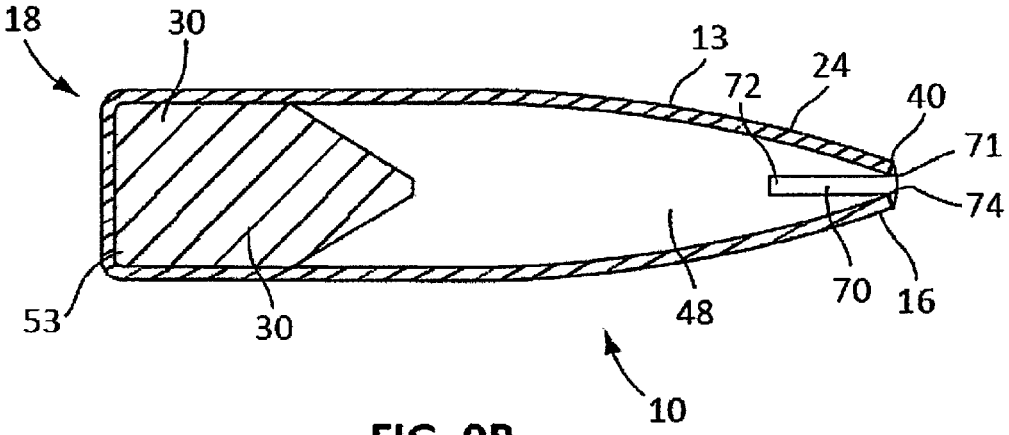
FIG. 9B is a cross-sectional side view of the projectile according to certain aspects of the present invention.

In a further aspect of the invention as shown in FIGS. 9A-9B, the projectile as described above with regard to FIGS. 7A-7B further may comprise a rod 70 or other shape internally suspended from or attached to the nose 16. The rod 70 may comprise any suitable material including, but not limited to, rigid polymer material and any rigid metallic material suitable for use as ballistic projectiles. The rod 70 includes a first end 71 attached to the jacket end 40 at the nose 16 and a second end 72 suspended in open cavity 48. The rod 70 is attached to the jacket end 40 via an interface 74 between the rod 70 and the jacket end 40. The interface 74 may comprise a bonding material, wherein the bonding material melts under the frictional heat the nose 16 is subject to during the ballistic phase. The rod 70 is linearly aligned with the projectile axis 17. In a further aspect of the invention, the rod 70 may be removed or replaced with other material.

Upon firing of the projectile, the extreme temperatures that the nose 16 is subject to during the ballistic phase melts the interface 74 between the jacket end 40 and the rod 70, leading to a release of the rod 70 into open cavity 48 which may cause catastrophic angle of attack failure at a pre-determined range due to a dramatic CG offset as the core axis becomes misaligned with the projectile axis 17, leading to an accelerated loss of forward velocity.

The projectiles of the present invention may be constructed as centerfire projectiles.

The projectiles disclosed here may be sized and shaped to be used as small caliber rifle projectiles. Caliber sizes may include those caliber sizes between and including .22 to .50 and 5.56 mm to 7.62 mm. Examples of calibers may include .22, .223, .243, .270, .300, .308, .30-30, 30-06, .45-70, .50, 5.56 mm, 7 mm, 7.62 mm.

The projectiles disclosed here may be sized and shaped to be used as ammunition of handguns. Caliber sizes may include those caliber sizes between and including .38 to .50 and 9 mm to 10 mm. Examples of calibers may include 9 mm, 10 mm, .38, .40, .41, .44, .45, .50, .300, .357, and .38.

Examples of suitable materials for the jacket include, but are not limited to, conventional jacket material, copper, aluminum, copper alloys, aluminum alloys, brass, tin, tungsten, zinc, iron, and steel and alloys thereof and combinations thereof.

Examples of suitable lower melting point materials include, without limitation, tin, zinc, bismuth, indium, and alloys thereof, and combinations thereof.

Examples of suitable higher melting point materials include, without limitation, lead, lead alloys, tungsten, tungsten alloys, metal containing composites, copper, brass, bronze, steel, and aluminum and alloys thereof and combinations thereof.

Other suitable materials may be found in the incorporated references listed herein, which are incorporated herein by references in their entireties.

The projectiles of the present invention, including all of the aspects and embodiments, are adapted for mounting in a cartridge case for firing. The states of the projectile and cartridge aspects and embodiments described are unfired and prefired states and are undeformed and ready for conventional use.

The above and below references in all sections of this application are herein incorporated by references in their entirety for all purposes, including to extent that they aid in materials, formulations, formulation methods and materials for making and using the compositions of the present invention, including materials used for the core, first material and second material based on melting temperatures and ballistic phase conditions.

REFERENCES

| | | |
|---|---|---|
| U.S. Pat. No. 4,063,511 | U.S. Pat. No. 4,708,065 | U.S. Pat. No. 4,520,972 |
| U.S. Pat. No. 5,932,836 | U.S. Pat. No. 4,905,602 | U.S. Pat. No. 6,439,124 |
| U.S. Pat. No. 6,016,754 | U.S. Pat. No. 6,983,700 | U.S. Pat. No. 5,001,986 |
| U.S. Pat. No. 4,519,316 | U.S. Pat. No. 4,411,200 | U.S. Pat. No. 4,140,061 |
| U.S. Pat. No. 8,256,352 | U.S. Pat. No. USH770 | U.S. Pat. No. 7,412,930 |
| U.S. Pat. No. 4,936,218 | U.S. Pat. No. 4,827,847 | U.S. Pat. No. 8,327,768 |
| U.S. Pat. No. 4,413,566 | U.S. Pat. No. 6,158,350 | U.S. Pat. No. 5,279,787 |
| U.S. Pat. No. 5,385,101 | U.S. Pat. No. 5,375,529 | U.S. Pat. No. 4,242,960 |
| U.S. Pat. No. 5,500,183 | U.S. Pat. No. 5,665,808 | U.S. Pat. No. 6,048,379 |
| U.S. Publication No. 20060283314 | U.S. Publication No. 20060027129 | U.S. Pat. No. 5,399,187 |
| U.S. Pat. No. 7,503,260 | U.S. Pat. No. 6,536,352 | U.S. Pat. No. 4,334,478 |
| EP Patent No. 0090888 | EP Patent No. 0169171 | EP Patent No. 0036231A1 |
| EP Patent No. 0752571 | | |

For purposes of interpreting the claims for the present invention, it is expressly intended that the provisions of Section 112, sixth paragraph of 35 U.S.C. are not to be invoked unless the specific terms "means for" or "step for" are recited in a claim All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A projectile used in a cartridge, the projectile having an elongated body with a nose at one end and a base at another end, the base mounted in a cartridge case, wherein the nose and the base are aligned along a central longitudinal axis of the elongated body, the projectile comprising:

a jacket having a first end, a second end, an outer surface and an inner surface, wherein the inner surface of the jacket defines a cavity and wherein the first end of the jacket forms at least a portion of the base of the projectile, the first end of the jacket having a plurality of apertures formed therein; and a core situated at least partially within the cavity of the jacket, the core being an elongated body with a first end at the base of the projectile and a second end, the core comprising a first core material, the first core material having a melting point that is no greater than ballistic phase temperatures resulting from firing said projectile, whereby, when the projectile is in a ballistic phase of a firing of said projectile, the first core material is at least partially discharged from the projectile through the plurality of apertures due to melting of the first core material by heat generated during the ballistic phase and as a result thereof the projectile loses mass and has an accelerated loss of forward velocity.

2. The projectile of claim 1, the core second end at least partially forming the nose of the projectile, the core further comprising a second core material fixed to the jacket, wherein the melting point of the first core material is less than the melting point of the second core material, the first core material and the second core material being substantially distinct and each being substantially linearly aligned along the longitudinal axis of the projectile with the first core material forming the first end of the core and the second core material forming the second end of the core, whereby, when the projectile is in a ballistic phase of a firing of said projectile, the first core material is at least partially discharged from the projectile through the plurality of apertures due to melting of the first core material by heat generated during the ballistic phase and as a result thereof the center of gravity of the projectile moves adjacent to the center of pressure causing the projectile to become unstable and lose linear velocity.

3. The projectile of claim 2, wherein total open area defined by all of the at least one apertures is asymmetrically spaced around the longitudinal axis of the projectile.

4. The projectile of claim 1, wherein total open area defined by all of the at least one apertures is asymmetrically spaced around the longitudinal axis of the projectile.

5. The projectile of claim 1, the second end of the jacket at least partially forming the nose of the projectile, wherein the cavity of the jacket comprises an open cavity portion between the core and the nose along the longitudinal axis of the projectile.

6. The projectile of claim 5, wherein the core comprises at least one channel formed in the first core material, the at least one channel being longitudinal aligned relative to the longitudinal axis of the projectile and opening at an end into the open cavity portion.

7. The projectile of claim 6, wherein the at least one channel is positioned radially within the first core material.

8. The projectile of claim 6, wherein the at least one channel is positioned between the first core material and the inner surface of the jacket.

9. The projectile of claim 5, wherein total open area defined by all of the at least one apertures is asymmetrically spaced around the longitudinal axis of the projectile.

10. The projectile of claim 5, wherein a portion of the jacket which is positioned radial around the first core material of the core increases in thickness in the direction of nose to base.

11. The projectile of claim 1, further comprising a second core material, wherein the second core material is radially fully within the first core material.

* * * * *